US009478190B2

(12) United States Patent
Lin et al.

(10) Patent No.: US 9,478,190 B2
(45) Date of Patent: Oct. 25, 2016

(54) VIDEO CARD AND COMPUTER

(71) Applicant: ShenZhen Goldsun Network Intelligence Technology Co., Ltd., Shenzhen (CN)

(72) Inventors: Ching-Chung Lin, New Taipei (TW); Fu-Shan Cui, Shenzhen (CN)

(73) Assignee: ShenZhen Goldsun Network Intelligence Technology Co., Ltd., ShenZhen (CN)

( * ) Notice: Subject to any disclaimer, the term of this patent is extended or adjusted under 35 U.S.C. 154(b) by 173 days.

(21) Appl. No.: 14/068,054

(22) Filed: Oct. 31, 2013

(65) Prior Publication Data

US 2014/0125684 A1 May 8, 2014

(30) Foreign Application Priority Data

Nov. 7, 2012 (CN) ..... 2012 1 0440254

(51) Int. Cl.
*G09G 5/00* (2006.01)
*G09G 5/36* (2006.01)

(52) U.S. Cl.
CPC ..... *G09G 5/006* (2013.01); *G09G 5/363* (2013.01); *G09G 2330/02* (2013.01); *G09G 2330/021* (2013.01); *G09G 2370/12* (2013.01)

(58) Field of Classification Search
None
See application file for complete search history.

(56) References Cited

U.S. PATENT DOCUMENTS 7,024,569 B1 * 4/2006 Wright ..... G06F 1/266 713/300
2004/0085308 A1 * 5/2004 Oh ..... G06F 1/3203 345/212
2006/0092152 A1 * 5/2006 Jang ..... G09G 5/006 345/211
2007/0195099 A1 * 8/2007 Diard ..... G06T 1/20 345/501
2009/0079877 A1 * 3/2009 Tomimitsu ..... H04N 5/775 348/708
2009/0256922 A1 * 10/2009 Gersten ..... H04N 5/4401 348/222.1

OTHER PUBLICATIONS

HDMI—wiki ("HDMI", https://web.archive.org/web/20111018075841/http://en.wikipedia.org/wiki/Hdmi ).*
DDWG ("Digital Visual Interface DVI", 1999, http://www.cs.unc.edu/~stc/FAQs/Video/dvi_spec-V1_0.pdf).*
VGA—wiki ("VAG connector", https://web.archive.org/web/20120611062558/http://en.wikipedia.org/wiki/VGA_connector).*
HwB ("VGA (VESA DDC)", 2010, https://web.archive.org/web/20101216045057/http://hardwarebook.info/VGA_(VESA_DDC).*

* cited by examiner

*Primary Examiner* — Kee M Tung
*Assistant Examiner* — Xin Sheng
(74) *Attorney, Agent, or Firm* — Zhigang Ma

(57) ABSTRACT

A video card includes a graphics processing unit, a video interface, and a power interface. The graphics processing unit processes video signals that are not supported by a display device and generates display signals that are supported by the display device. The video interface transmits the display signals to the display. The power interface supplies a first voltage to the display device via the video interface, so as to power on the display device to display the display signals.

18 Claims, 4 Drawing Sheets

VIDEO CARD AND COMPUTER

BACKGROUND

1. Technical Field

The present disclosure relates to a display technology, and particularly to a video card and a computer using the video card.

2. Description of Related Art

Video cards include a graphics processing unit (GPU) and a number of video interfaces, such as a video graphics array (VGA) interface, a digital visual interface (DVI), and a high-definition multimedia interface (HDMI), connected to a display device. The video card is located inside a computer having a power supply and a processor. The video card is electrically connected to the power supply and the processor. When the video interface is connected to the display device, the video card transmits a voltage from the processor to the display device. However, the voltage is too low to power on the display device.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
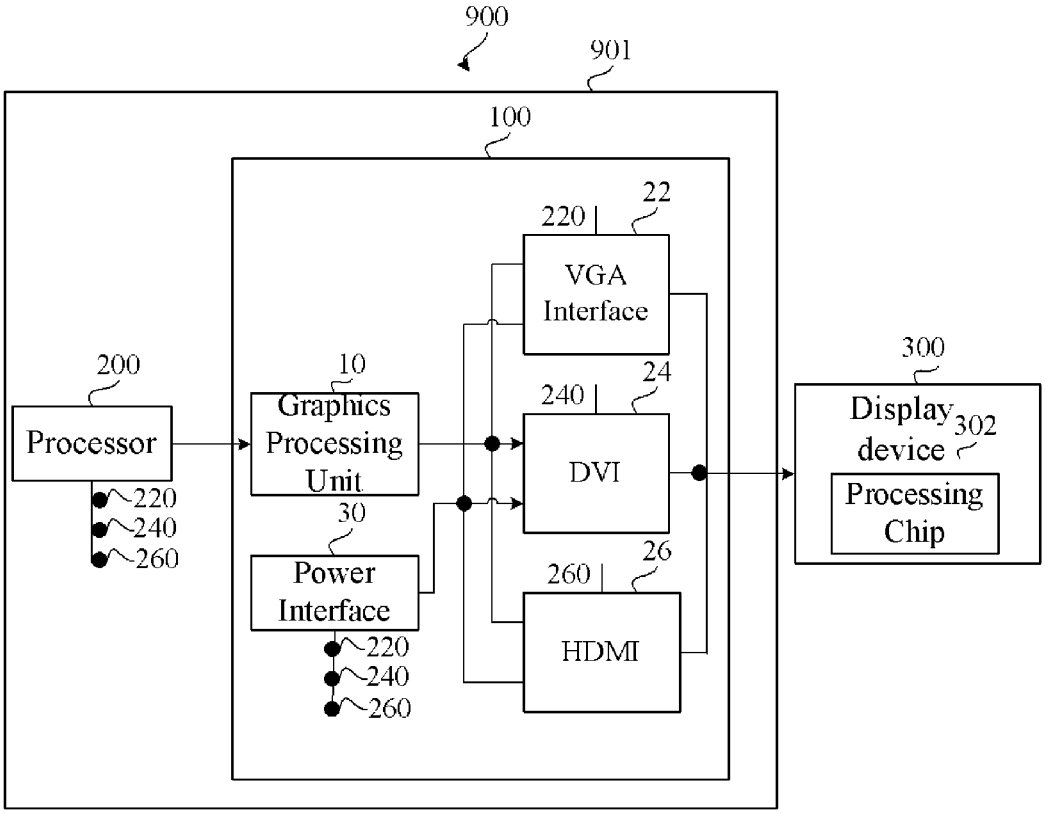
FIG. 1 shows function blocks of a video card according to an embodiment of the disclosure.

FIG. 1 shows a display system 900 of an embodiment. The display system 900 includes a video card 100, a processor 200, and a display device 300. The video card 100 and the processor 200 are on a motherboard of a computer 901. The display device 300 includes a processing chip 302.

The video card 100 includes a graphics processing unit (GPU) 10, a power interface 30, and a number of video interfaces. In this embodiment, the video interfaces include a video graphics array (VGA) interface 22, a digital visual interface (DVI) 24, and a high-definition multimedia interface (HDMI) 26.

The GPU 10 is electrically connected to the processor 200. The GPU 10 receives video signals from the processor 200 that are not supported by the display device 300, processes the video signals to generate display signals that are supported by the display device 300, and transmits the display signals to the display device 300 via the VGA interface 22, the DVI 24, or the HDMI 26.

The power interface 30 supplies a first voltage to the display device 300 via the VGA interface 22, the DVI 24, or the HDMI 26, so as to power on the display device 300 to display the display signals.

In a first embodiment, the VGA interface 22, the DVI 24, and the HDMI 26 include power pins 220, 240, and 260, respectively. The power pins 220, 240, and 260 are all connected to the power interface 30 and the processor 200 to receive the first voltage from the power interface 30 and a second voltage from the processor 200. The first voltage is higher than the second voltage. The first voltage is capable of powering on the display device 300. The second voltage is capable of powering on just the processing chip 302. Thus, when the video card 100 is electrically connected to the display device 300 via the VGA interface 22, the DVI 24, or the HDMI 26, the first voltage is transmitted to the display device 300 via the power pin 220, 240 or 260 to power on display device 300.

Figure 2:
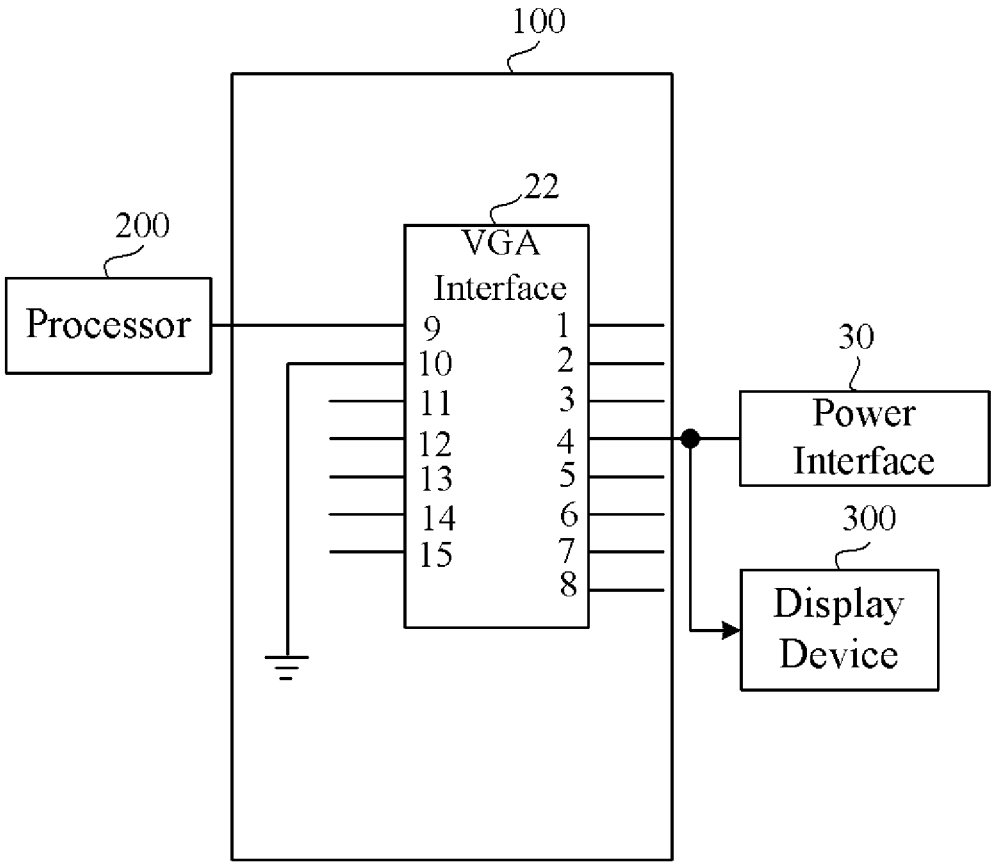
FIG. 2 shows a VGA interface of the video card of FIG. 1 connected to a display device, a power supply interface, and a processor.

FIG. 2 shows the display device 300 electrically connected to the video card 100 via the VGA interface 22 in accordance with a second embodiment. The VGA interface 22 includes a power pin 9, a monitor identification (ID) bit 0 pin 10, and a monitor ID bit 2 pin 4. In this embodiment, the monitor ID bit 0 pin 10 is grounded, and the monitor ID bit 2 pin 4 is electrically connected to the power interface 30, such that the first voltage is transmitted to the display device 300 via the monitor ID bit 2 pin 4. In other embodiments, the monitor ID bit 2 pin 4 is grounded, and the monitor ID bit 0 pin 10 is electrically connected to the power interface 30, such that the first voltage is transmitted to the display device 300 via the monitor ID bit 0 pin 224. In other embodiments, the monitor ID bit 2 pin 4 and the monitor ID bit 0 pin 10 are electrically connected to the power interface 30, and the monitor ID bit 0 pin 4 is electrically connected to the monitor ID bit 2 pin 4, such that the first voltage is transmitted to the display device 300 via the monitor ID bit 2 pin 4.

Figure 3:
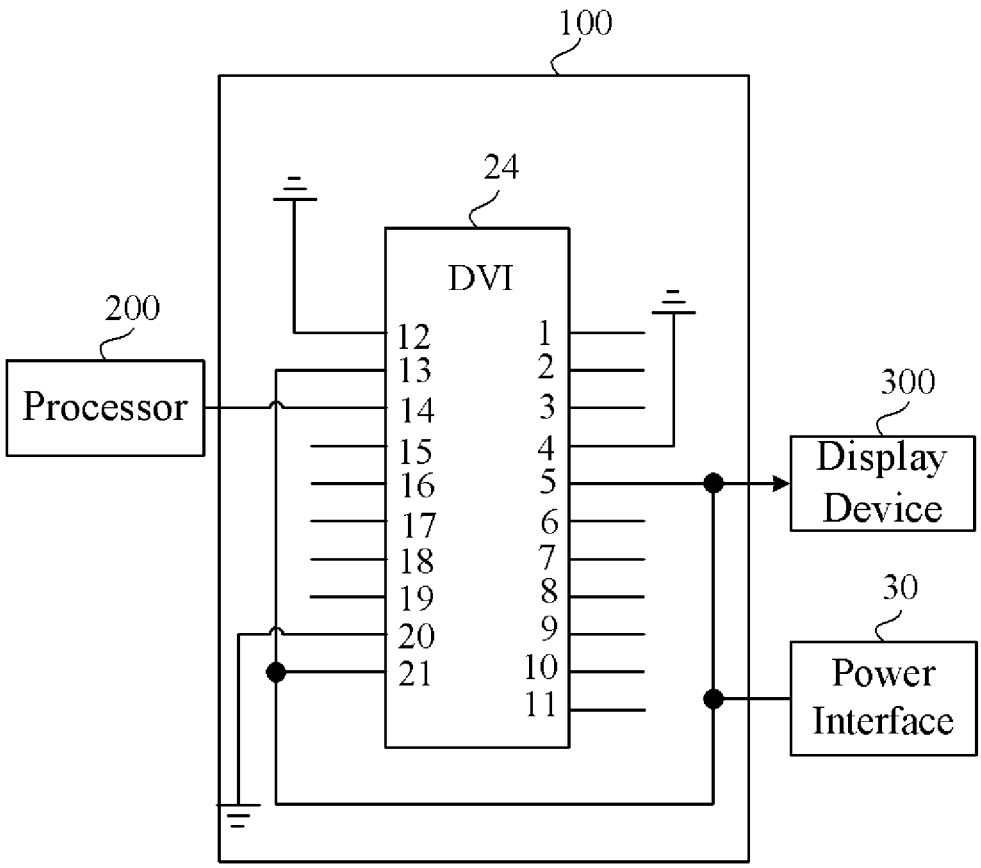
FIG. 3 shows a DVI of the video card of FIG. 1 connected to a display device, a power interface, and a processor.

FIG. 3 shows the display device 300 electrically connected to the video card 100 via the DVI 24 in accordance with a second embodiment. The DVI 24 further includes a theater medical data server (TMDS) data 3+pin 13, a TMDS data 3−pin 12, a TMDS data 4+pin 15, a TMDS data 4−pin 4, a TMDS data 5+pin 21, and a TMDS data 5−pin 20. The TMDS data 3−pin 12, the TMDS data 4−pin 4, and the TMDS data 5−pin 20 are grounded. The TMDS data 3+pin 13, the TMDS data 4+pin 15, and the TMDS data 5+pin 21 are electrically connected to the power interface 30 and the display device 300, such that the first voltage is transmitted to the display device 300 via the TMDS data 3+pin 13, the TMDS data 4+pin 15, and the TMDS data 5+pin 21. In other embodiments, the first voltage is transmitted to the display device 300 via any one or two of the TMDS data 3+pin 13, the TMDS data 4+pin 15, and the TMDS data 5+pin 21. In other embodiments, the TMDS data 3+pin 13, the TMDS data 3−pin 12, the TMDS data 4+pin 15, the TMDS data 4−pin 4, the TMDS data 5+pin 21, and the TMDS data 5−pin 20 are all electrically connected to the power interface 30, such that the first voltage is transmitted to the display device 300 via some of the TMDS data 3+pin 13, the TMDS data 3−pin 12, the TMDS data 4+pin 15, the TMDS data 4−pin 4, the TMDS data 5+pin 21, and the TMDS data 5−pin 20.

Figure 4:
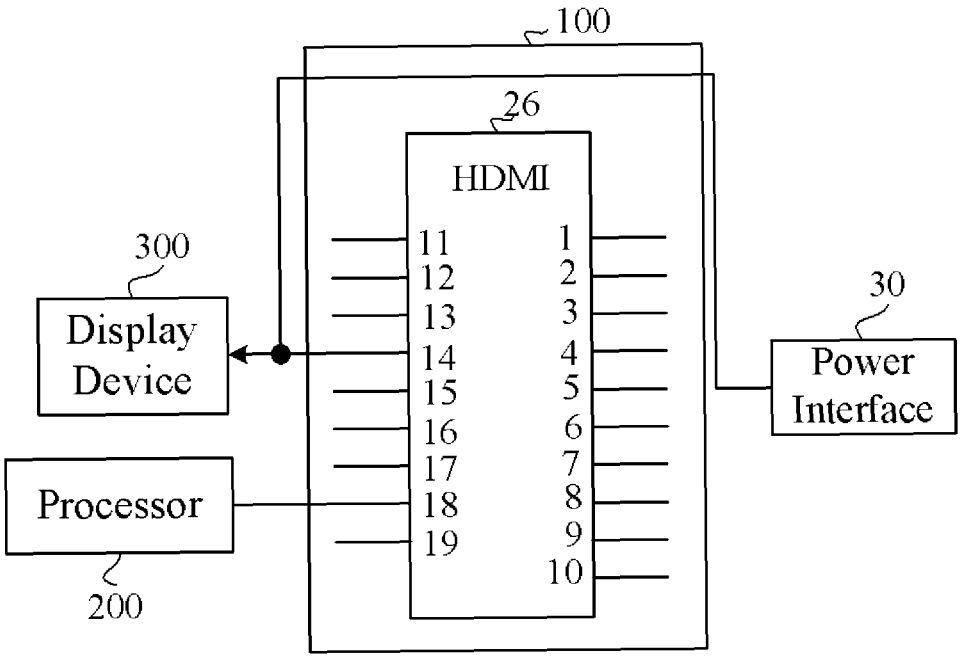
FIG. 4 shows an HDMI of the video card of FIG. 1 connected to a display device, a power interface, and a processor.

FIG. 4 shows the display device 300 electrically connected to the video card 100 via the HDMI 26 in accordance with a second embodiment. The HDMI 26 includes a reserved pin 14. The reserved pin 14 is electrically connected to the power interface 30, such that the first voltage is transmitted to the display device 300 via the reserved pin 14.

Even though relevant information and the advantages of the present embodiments have been set forth in the foregoing description, together with details of the functions of the present embodiments, the disclosure is illustrative only; and changes may be made in detail, especially in the matters of shape, size, and arrangement of parts within the principles of the present embodiments to the full extent indicated by the broad general meaning of the terms in which the appended claims are expressed.

What is claimed is:

1. A video card, comprising:

a graphics processing unit processing video signals that are not supported by a display device to generate display signals that are supported by the display device;

a video interface transmitting the display signal to the display device; and a power interface supplying a first voltage to the display device via the video interface, so as to power on the display device to display the display signal;

wherein the video interface comprises a VGA interface, the VGA interface includes a monitor ID bit 0 pin and a monitor ID bit 2 pin electrically connected to the monitor ID bit 0 pin, the monitor ID bit 0 is electrically connected to the power interface, the monitor ID bit 0 pin and the monitor ID bit 2 pin are connected to the power interface and the power interface transmits the first voltage to the display device via the monitor ID bit 2.

2. The video card of claim 1, wherein the video interface comprises a video graphics array (VGA) interface, the VGA interface includes a monitor identification (ID) bit 0 pin and a monitor ID bit 2 pin, the monitor ID bit 0 is electrically connected to the power interface, the monitor ID bit 2 is grounded, the power interface transmits the first voltage to the display device via the monitor ID bit 0.

3. The video card of claim 1, wherein the video interface comprises a VGA interface, the VGA interface comprises a monitor ID bit 2 pin, the monitor ID bit 2 pin are connected to the power interface, the power interface transmits the first voltage to the display device via the monitor ID bit 2.

4. The video card of claim 3, wherein the VGA interface further comprises a monitor ID bit 0 pin, the monitor ID bit 0 pin is grounded.

5. The video card of claim 1, wherein the video interface comprises a digital visual interface (DVI), the DVI comprises a TMDS data 3+pin, a TMDS data 3−pin, a TMDS data 4+pin, a TMDS data 4−pin, a TMDS data 5+pin, and a TMDS data 5−pin; the TMDS data 3+pin, the TMDS data 3−pin, the TMDS data 4+pin, the TMDS data 4−pin, the TMDS data 5+pin, and the TMDS data 5−pin are connected to the power interface; the power interface transmits the first voltage to the display device via one or more pins from the TMDS data 3+pin, the TMDS data 3−pin, the TMDS data 4+pin, the TMDS data 4−pin, the TMDS data 5+pin, and the TMDS data 5−pin.

6. The video card of claim 1, wherein the video interface comprises a DVI, the DVI comprises a TMDS data 3+pin, a TMDS data 3−pin, a TMDS data 4+pin, a TMDS data 4−pin, a TMDS data 5+pin, and a TMDS data 5−pin; the TMDS data 3+pin, the TMDS data 4+pin, and the TMDS data 5+pin are connected to the power interface; the TMDS data 3−pin, the TMDS data 4−pin, and the TMDS data 5−pin are grounded; the power interface transmits the first voltage to the display device via one or more pins from the TMDS data 3+pin, the TMDS data 4+pin, and the TMDS data 5+pin.

7. The video card of claim 1, wherein the video interface comprises a high definition multimedia interface (HDMI), the HDMI comprises a reserved pin, the reserved pin is electrically connected to the power interface, the power interface transmits the first voltage to the display device via the reserved pin.

8. The video card of claim 1, wherein the video interface comprises a power pin, the power pin is electrically connected to the power interface, the power interface transmits the first voltage to the display device via the power pin.

9. The video card of claim 8, wherein the power pin receives a second voltage to power on a processing chip of the display device, the second voltage is less than the first voltage.

10. A computer, comprising a video card, the video card comprising:

a graphics processing unit processing video signals that are not supported by a display device to generate display signals that are supported by the display device;

a video interface transmitting the display signal to the display device; and a power interface supporting a first voltage to the display device via the video interface, so as to power on the display device to display the display signal;

wherein the video interface comprises a VGA interface, the VGA interface comprises a monitor ID bit 0 pin and a monitor ID bit 2 pin electrically connected to the monitor ID bit 0 pin, the monitor ID bit 0 is electrically connected to the power interface, the monitor ID bit 0 pin and the monitor ID bit 2 pin are connected to the power interface and the power interface transmits the first voltage to the display device via the monitor ID bit 2.

11. The computer of claim 10, wherein the video interface comprises a VGA interface, the VGA interface comprises a monitor ID bit 0 pin and a monitor ID bit 2 pin, the monitor ID bit 0 is electrically connected to the power interface, the monitor ID bit 2 is grounded, the power interface transmits the first voltage to the display device via the monitor ID bit 0.

12. The computer of claim 10, wherein the video interface comprises a VGA interface, the VGA interface comprises a monitor ID bit 2 pin, the monitor ID bit 2 pin are connected to the power interface, the power interface transmits the first voltage to the display device via the monitor ID bit 2.

13. The computer of claim 12, wherein the VGA interface further comprises a monitor ID bit 0 pin, the monitor ID bit 0 pin is grounded.

14. The computer of claim 10, wherein the video interface comprises a DVI, the DVI comprises a TMDS data 3+pin, a TMDS data 3−pin, a TMDS data 4+pin, a TMDS data 4−pin, a TMDS data 5+pin, and a TMDS data 5−pin; the TMDS data 3+pin, the TMDS data 3−pin, the TMDS data 4+pin, the TMDS data 4−pin, the TMDS data 5+pin, and the TMDS data 5−pin are connected to the power interface; the power interface transmits the first voltage to the display device via one or more pins from the TMDS data 3+pin, the TMDS data 3−pin, the TMDS data 4+pin, the TMDS data 4−pin, the TMDS data 5+pin, and the TMDS data 5−pin.

15. The computer of claim 10, wherein the video interface comprises a DVI, the DVI comprises a TMDS data 3+pin, a TMDS data 3−pin, a TMDS data 4+pin, a TMDS data 4−pin, a TMDS data 5+pin, and a TMDS data 5−pin; the TMDS data 3+pin, the TMDS data 4+pin, and the TMDS data 5+pin are connected to the power interface; the TMDS data 3−pin, the TMDS data 4−pin, and the TMDS data 5−pin are grounded; the power interface transmits the first voltage to the display device via one or more pins from the TMDS data 3+pin, the TMDS data 4+pin, and the TMDS data 5+pin.

16. The computer of claim 10, wherein the video interface comprises a HDMI, the HDMI comprises a reserved pin, the reserved pin is electrically connected to the power interface, the power interface transmits the first voltage to the display device via the reserved pin.

17. The computer of claim 10, wherein the video interface comprises a power pin, the power pin is electrically connected to the power interface, the power interface transmits the first voltage to the display device via the power pin.

18. The computer of claim 17, further comprising a processor, the processor outputs a second voltage lower than the first voltage to the power pin, the power pin transmitted the second voltage to the display device to power on a processing chip of the display device.

* * * * *